United States Patent [19]

Belony

[11] 4,236,720

[45] Dec. 2, 1980

[54] TILE OR CARD GAME

[76] Inventor: Jean-Claude M. J. Belony, 2803 Keith St., Marlow Heights, Md. 20031

[21] Appl. No.: 14,724

[22] Filed: Feb. 23, 1979

[51] Int. Cl.[3] ..... A63F 9/20

[52] U.S. Cl. ..... 273/292

[58] Field of Search ..... 273/292, 293, 294, 295, 273/303, 304, 305

[56] References Cited

U.S. PATENT DOCUMENTS

| | | | |
|---|---|---|---|
| 854,547 | 5/1907 | Werner | 273/292 X |
| 1,693,525 | 11/1928 | Niederlitz | 273/304 |
| 2,063,941 | 12/1936 | McCarroll | 273/292 |
| 2,383,081 | 8/1945 | Ribbe | 273/292 X |
| 4,147,363 | 4/1979 | Lee et al. | 273/304 |

FOREIGN PATENT DOCUMENTS

| | | | |
|---|---|---|---|
| 519336 | 3/1940 | United Kingdom | 273/304 |

*Primary Examiner*—Anton O. Oechsle

*Attorney, Agent, or Firm*—Fleit & Jacobson

[57] ABSTRACT

A game apparatus for a game utilizing a plurality of playing pieces, each piece having two, three or four sections with each section bearing one of a number of preselected designs with no piece bearing more than one of any particular design. Each playing piece is also associated with a number, which may be borne thereon. In a set of pieces for the mode N-S, the numbers associated with each piece, the number of sections per piece and the designs placed on each section we selected so that the sum of the numbers associated with N pieces having one and only one design in common is S.

23 Claims, 8 Drawing Figures

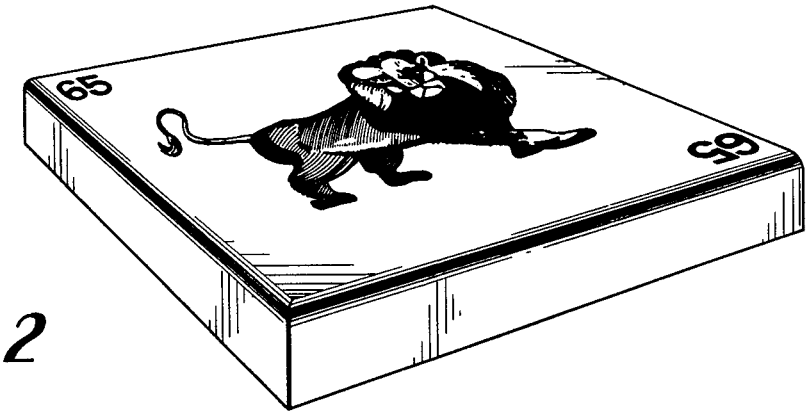
FIG. 2
FIG. 3
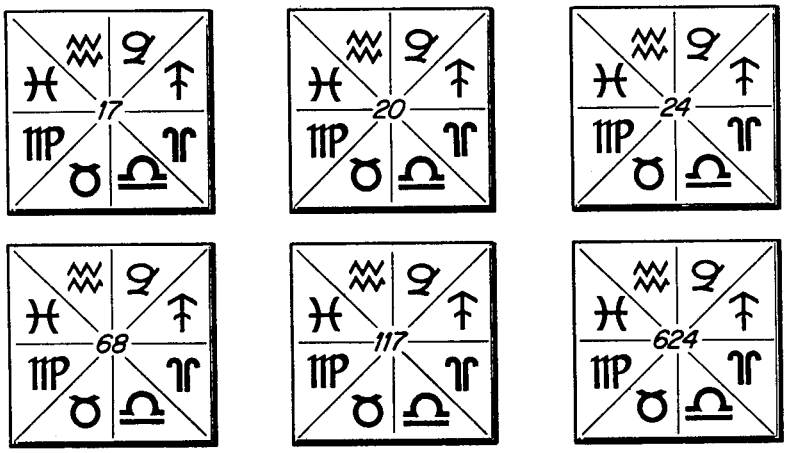
FIG. 4
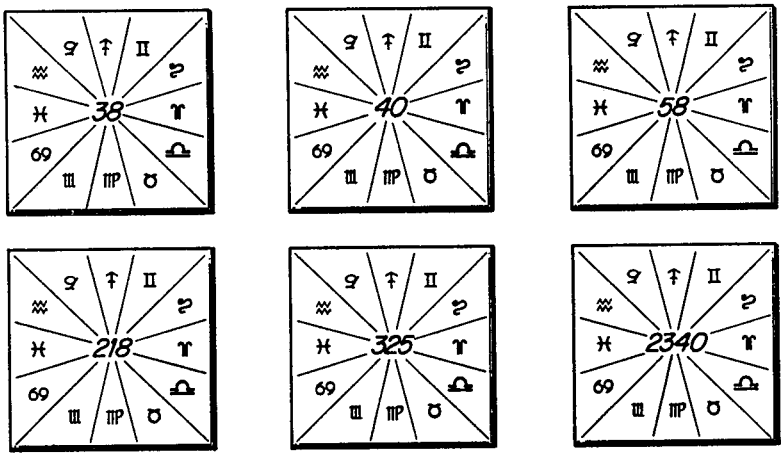

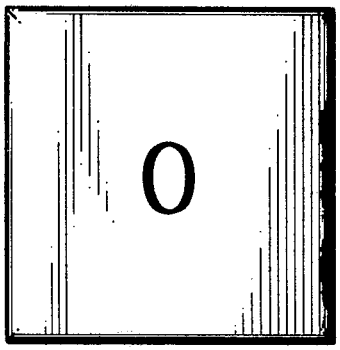
FIG. 6
FIG. 7
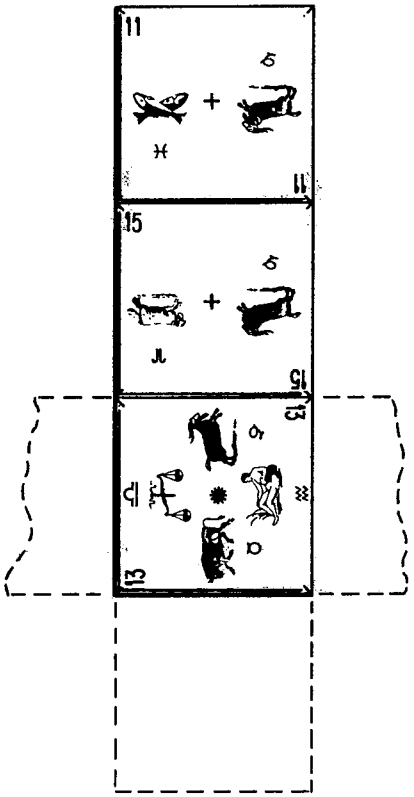
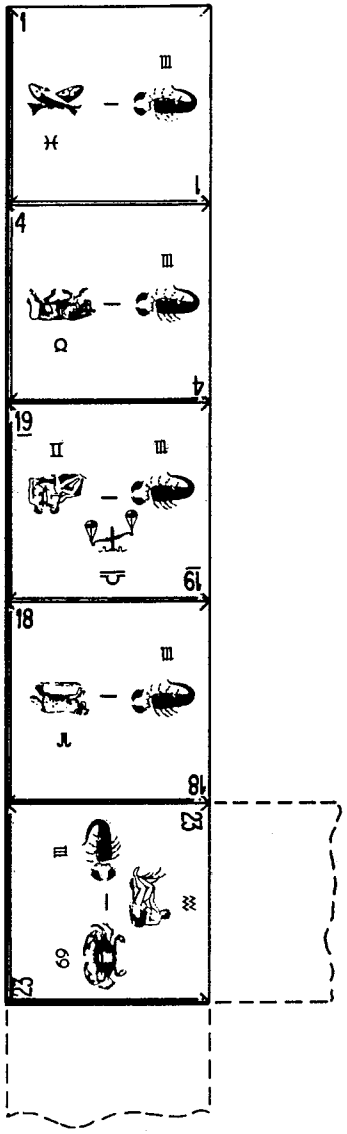
FIG. 8

TILE OR CARD GAME

BACKGROUND OF THE INVENTION

1. Field of the Invention

The present invention relates generally to games and more particularly to a game utilizing a plurality of tiles with each tile bearing various preselected indicia thereon.

2. Summary of the Invention

The present invention provides a game apparatus for a game utilizing a plurality of playing pieces or tiles each piece having either two, three or four sections with each section bearing one of a number of preselected designs with no piece bearing more than one of any particular design. Each playing piece or tile is also associated with a number. The numbers associated with each piece, the number of sections per piece and the designs placed on each section are selected so that the sum of the numbers associated with N number of pieces having one and only one design in common is S. This produces a game having the mode N-S.

It is an object of the present invention to provide a game which is both educational and enjoyable and which can be played by people of all ages.

It is another object of the present invention to provide a game that will be enjoyable by people who love numbers and mathematical recreation.

It is yet another object of the present invention to provide an interesting and enjoyable game which can be readily learned by educated people.

It is a further object of the present invention to provide an interesting and enjoyable game which is educational and which enables the participant to devise various strategies and utilize these strategic tactics in an educational environment.

It is still another object of the present invention to provide a game apparatus having a harmonious correspondence between the designs and numbering of the playing pieces and to provide a game which produces a most beautiful layout when played.

These and other objects of the present invention will become apparent from the present description, drawings and appended claims.

BRIEF DESCRIPTION OF THE DRAWINGS

FIG. 2 is a perspective view of a typical playing piece.

FIG. 3 is a top plan view of a set of small bonus pieces for a game having the mode 5–65.

FIG. 4 is a top plan view of a set of big bonus pieces for a game having the mode 5–65.

FIG. 6 is a top plan view of a universal bonus piece.

FIG. 7 is a top plan view of three basic pieces as actually played in a game having the mode 3–39.

FIG. 8 is a top plan view of five basic pieces as actually played in a game having the mode 5–65.

DESCRIPTION OF THE PREFERRED EMBODIMENTS

General Description

Figure 1:
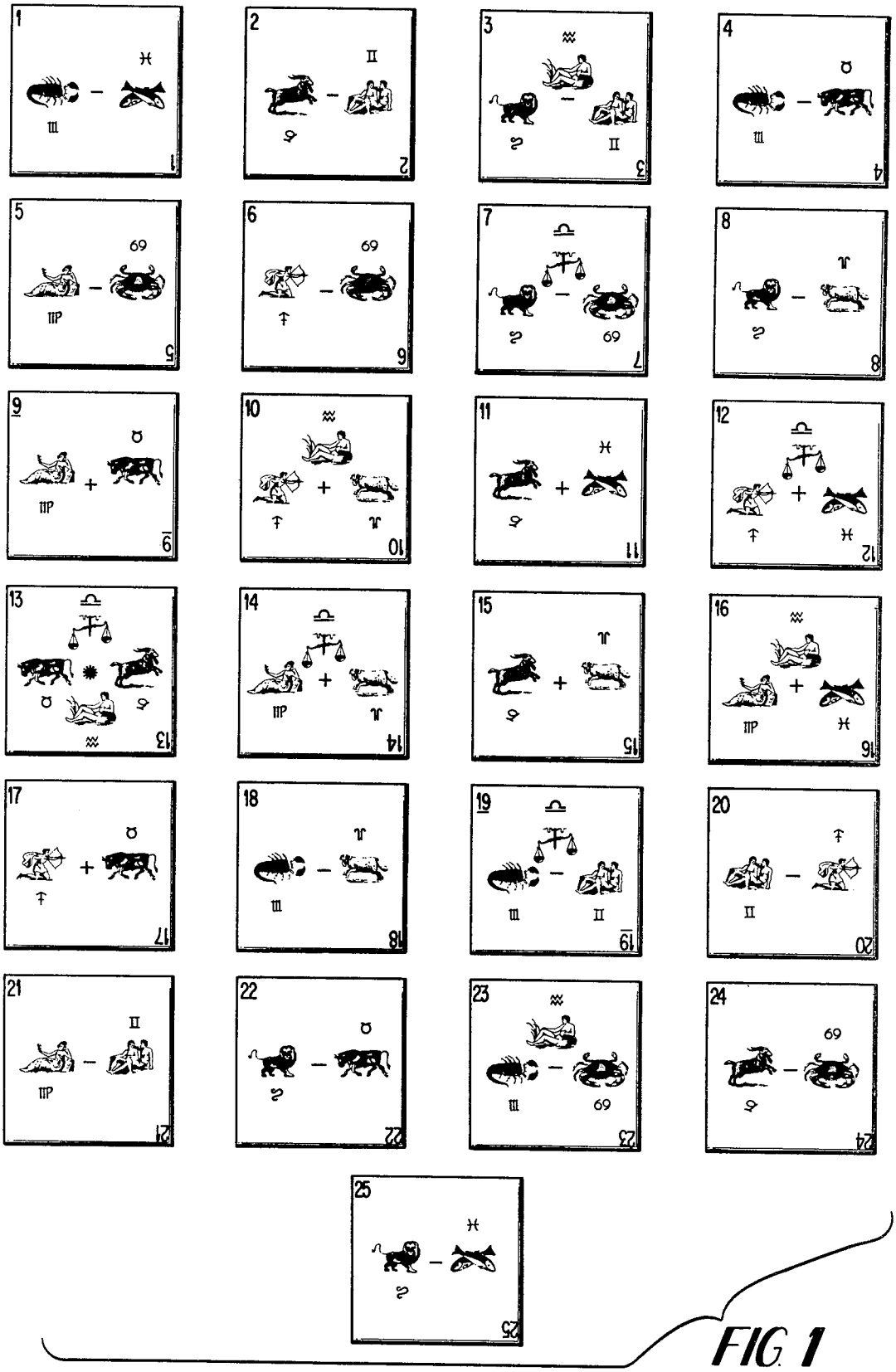
FIG. 1 is a top plan view of a set of distinctive basic playing pieces for a game having the mode 5–65.

The present invention provides a game apparatus employing playing pieces, examples of which are described in detail below. The playing pieces typically can resemble dominoes or tiles employed in the Chinese game of Mah-Jongg. It should be understood, however, that the term "playing piece" as employed herein refers to any means capable of bearing an indicia such as, for example, a playing card. In a preferred embodiment, each playing piece is square shaped and about $1\frac{1}{4}$ inch on a side. Further, the face of each piece bears at least one design and is associated or marked with a number, preferably an integer. Certain exceptional pieces bear the number zero, some pieces have more than one design, and some pieces may even bear as many designs as used in the game. It should be noted that the term "design" as employed in the present specification means any indicia, e.g. letters, numbers, colors, etc. and is not limited to the specific designs disclosed. The design on the face of the playing piece is directly related to the number associated therewith, and each tile is also completely harmonized with the design and number on the face of each of the other pieces that constitute the game. This harmonious correspondence between the designs and numbering of the playing pieces makes the present game one of the most mathematical and most beautiful games imaginable. It should be noted that the pieces can be made of very high quality and can be formed out of ivory with the designs sculptured therein.

The present invention provides a game in which each player plays a piece in turn, if he is able, from one of the different pieces he has according to the precise rules of the game. If tiles are employed, they are placed on a playing surface with their edges touching so that corresponding designs line up or match. The actual play of a playing piece is described in detail below.

In playing a piece, a player can attempt to prevent subsequent players from playing a piece in turn. Being unable to play in turn constitutes a pass. The player who succeeds in putting down all of his pieces before any other player, wins the game. In playing the game, a player is urged to use his intellectual and psychological resources by employing certain feints and other techniques within the rules that will become evident as one becomes acquainted with the game and its mathematical basis.

Varieties of Playing

The present invention provides a game that is capable of play in an almost unlimited number of varieties or modes. The mode of the game is expressed in terms of a two numbers, N-S, which typically are integers. No matter what the mode is, however, the particular designs on a piece, the number of sections on the piece and the number associated with a piece are selected so that the sum of the numbers associated with N pieces having one and only one design in common equals S. For example, in the mode 3–15, the sum of the numbers associated with three pieces having one and only one design in common is 15. As a corrollary to the N-S mode, the mode may also be referred to as $N^2$. By raising the first digit of the mode, N, to the second power, one is able to determine the number of different numbers required for association with the playing pieces to be used in playing a game having that mode. For example, the mode 3–15 requires $3^2$ or nine different numbers for the playing pieces.

The mode 5–65 is described herein in complete detail. Also described herein, is a smaller game of mode 3–39, which can be constructed from the pieces from the mode 5–65 game. Also briefly described is the mode 3–15, which is essentially equivalent to the mode 3–39 except for the numbers placed on the pieces.

For purpose of description, the numbers associated with a piece are referred to as either on the piece or borne by the piece or by some equivalent expression, even though the piece is not actually required to possess numerical indicia.

Detailed Explanation of Mode 5–65

In mode 5–65, the present invention provides a game typically consisting of 218 pieces of three types. There are 180 basic pieces which constitute the basic game and which may be employed without the remainder of the pieces. In mode 5–65, there may be an additional twenty special or punishing pieces and eighteen bonus pieces giving a total of 218 pieces. The use of 218 pieces in a game of mode 5–65 provides two games instead of one. When all 218 pieces are employed, a large size game results which can be played from 4–12 players. A smaller game may be constructed be selecting only 68 specific pieces from the 218 to provide a game playable by from 2–8 players. This game has the mode 3–39 and will be explained after the detailed description of all the pieces in the mode 5–65.

FIG. 1 shows a set of distinct basic pieces employed in the mode 5–65. These are the main pieces for the game, and each piece bears one number selected from the integers between 1 and 25 inclusive on its face. As can be seen from FIG. 1, there are three kinds of basic pieces. There are 16 distinct pieces having two sections, two-section pieces. There are 8 distinct pieces having three sections, three-section pieces. Finally, there is a unique piece having four sections, the four-section piece. To provide the requisite basic pieces for the mode 5–65 in a preferred embodiment requires the provision of three identical sets of 60 basic playing pieces. Each set consists of two each of the sixteen distinct 2-section pieces, three each of the eight distinct 3-section pieces and four of the unique 4-section piece. As can also be seen from FIG. 1, each of the 2-section pieces bears a number selected from the group consisting of 1, 2, 4, 5, 6, 8, 9, 11, 15, 17, 18, 20, 21, 23, 24 and 25; each of the 3-section pieces bear a number selected from the group consisting of 3, 7, 10, 12, 14, 16, 19 and 23; and each of the 4-section pieces bear the number 13.

As also seen in FIG. 1, each piece is divided into either 2, 3 or 4 sections. Each section of the playing piece bears one of 12 different preselected indicia. In a preferred embodiment, as illustrated in FIG. 1, these indicia are astrological symbols, although any design or indicia, such as color, may be employed. A specific color may also be assigned to each design to further distinguish the designs.

In FIG. 1, the ram represents Aries; the bull represents Taurus; the twins represent Gemini; the crab represents Cancer; the lion represents Leo; the reclining woman represents Virgo; the scales represent Libra; the scorpion represents Scorpio; the archer represents Sagittarius; the long-horned goat represents Capricorn; the water bearer represents Aquarius; and the fish represent Pisces. The designs are placed on the basic pieces so that the sum of the numbers on any five pieces having one and only one design in common is 65. For example, in FIG. 1, the pieces bearing the numbers 1, 4, 18, 19, and 23 have only the design representative of the astrological sign Scorpio in common. The numbers on the pieces total 65.

In addition to the basic pieces, which may be employed alone in playing the present game to eliminate the element of chance, in a preferred embodiment there are three types of bonus pieces that may be employed. These are the small bonus pieces, the big bonus pieces and the universal bonus pieces. There are typically six of each type making a total of 18 bonus pieces. A preferred embodiment of these bonus pieces is shown in FIGS. 3, 4 and 6. In the illustrated embodiment employing astrological symbols, the standard zodiacal representations have been employed on the bonus pieces due to the large number of symbols required in a limited space. These representations may also be employed, as illustrated in conjunction with the designs on the basic pieces for ease of play.

The small bonus pieces, shown in FIG. 3, are divided into eight sections with each section bearing a different one of eight of the preselected designs. Each piece bears the same eight designs and one number selected from the group consisting of 17, 20, 24, 68, 117 and 624. Thus, the small bonus pieces, which are the bonus pieces for use in the mode 3–39, are identical except for the number borne thereon.

The big bonus pieces, shown in FIG. 4, have twelve different sections with each section bearing a different one of the twelve preselected designs. Each big bonus piece further bears one number selected from the group consisting of 38, 40, 58, 218, 325, and 2340. Like the small bonus pieces, the big bonus pieces are identical except for the numerical indicia on their face.

Finally, there are typically six identical universal bonus pieces each of which has only one section and has no design. Each universal bonus piece bears the numeral zero. A typical universal bonus piece is shown in FIG. 6. The number of universal bonus pieces may be varied to produce a number of pieces evenly divisible by the number of players in the game, so each player will have the same number of pieces initially.

Figure 5:
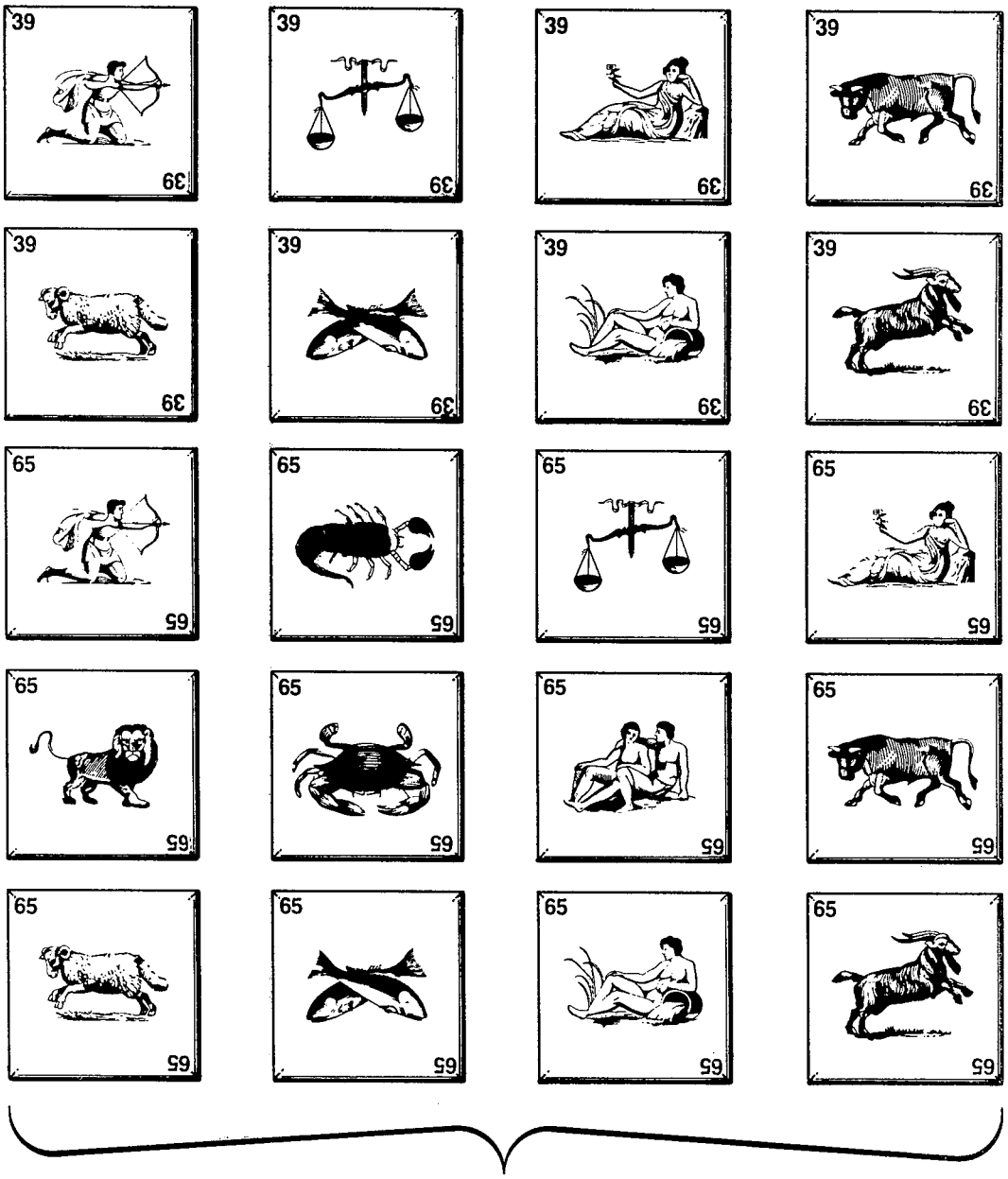
FIG. 5 is top plan view of a set of special pieces for a game having the mode 5–65.

In addition to the three types of bonus pieces, two types of punishing pieces or special pieces may be employed in the mode 5–65. These pieces in effect serve to punish the players who have them, since they are not advantageous pieces because they bear only one design on their face and have a high valued numeral. First, there are 12 greater punishing pieces, each of which bears one of the 12 preselected designs and the numeral 65. Second, there are eight low punishing pieces, each of which bears one of the eight preselected designs from the small bonus pieces and the numeral 39. Thus, there are 20 punishing pieces. These pieces are shown in FIG. 5.

In FIG. 1, it can be seen that on the face of each piece, in addition to the astrological symbol or symbols and the number thereon, there is an additional symbol, which may be a mathematical sign, which in a preferred embodiment is shown as either a + (plus) or a − (minus). It should be noted that typically only the 2-section and 3-section pieces bear these particular mathematical signs. The 4-section piece which bears the number 13 also bears a third symbol which may be a star or asterisk on its center. These symbols are employed to facilitate the construction of the 3–39 mode game from the large set of 5–65 mode playing pieces.

The present game in mode 3–39 is a smaller game which can be played by from 2–8 players. To form a set of playing pieces for the mode 3–39, one would first select all the pieces from the mode 5–65 which bear the numbers from 9–17 inclusive. The illustrated pieces bear the arithmetical symbol + (plus) at their center, except for the piece which bears the number 13 which also bears the star or asterisk. After removing these pieces from the 5–65 set, one will have six pieces bearing the number 9, nine pieces bearing the number 10, six pieces bearing the number 11, nine pieces bearing the number 12, twelve pieces bearing the number 13, nine pieces bearing the number 14, six pieces bearing the number 15, nine pieces bearing the number 16 and six pieces bearing the number 17 for a total of 72 basic pieces. This, however, is too many pieces for the mode 3–39, since only $\frac{2}{3}$ of that quantity of pieces is required. The players will, therefore, eliminate two of the pieces bearing the numbers 9, 11, 15 and 17, three of the pieces bearing the numbers 10, 12, 14 and 16 and four of the pieces bearing the number 13 which will provide the requisite total of 48 basic pieces for the mode 3–39.

If the players decide to employ the bonus pieces and special pieces, they are generally selected as follows. The special pieces for the mode 3–39 are the small special pieces of the mode 5–65, i.e., the eight 1-section pieces bearing the number 39. The bonus pieces generally employed in the mode 3–39 are the small bonus pieces of the mode 5–65, i.e. the 8-section pieces bearing the numbers 17, 20, 24, 68, 117, and 624. The universal bonus pieces generally employed in the mode 3–39 are identical to those employed in the mode 5–65. The number of universal bonus pieces employed in the game, however, may vary from 0 to 6 (or more) depending on the number and desire of the players.

Playing Procedures

The following rules are applicable for the modes 3–15, 3–39, and 5–65 as well as any other mode of the game. Any variations in rules relate chiefly to the number of pieces in the game and the number of players who may play at the same time.

Typically, the play begins as the playing pieces are placed faced-down and shifted around for about one minute to prevent anyone from remembering the location of any particular playing piece. Each player then takes a piece at random. The players then compare the numbers on the chosen pieces, and the player with the highest number has the right to place down the first piece. The player with the piece having the second highest number has the right to play second, and so forth with the lowest number holder playing last. The players then arrange themselves around the table. The game is played in a counterclockwise direction, the second player being to the right of the first, the third to the right of the second, and the last to the left of the first. All the pieces are then returned face down to the table and reshifted for another minute to prevent anyone from remembering the location of any single piece. Then, each player takes, again at random, a number of pieces equal to the total number of pieces employed in the game divided by the number of players. However, if there are only two players, then an additional sequence is required. When there are two players, a third imaginery player is postulated. Thus, each player takes the number of pieces due to him and the remainder to a third imaginary player are left on the side in the playing space. After each of the real players plays a piece, he takes one piece from among those left until they have been used up. Then the game continues as normal between the two players.

The postulation of a third imaginary player prevents the two actual players from knowing exactly which pieces are held by the opposing player. In fact, two players may decide to play without drawing any playing pieces from the imaginary third player.

Sometimes it is not very practical to shuffle the playing pieces to determine the order of play when the number of playing pieces employed is very high. When this occurs, it is possible to use dice, which are thrown by each player to determine the order of play. The first player is the one who scores the highest total on the roll of the dice and the last is the one who scores the lowest total.

Playing the Pieces

It is both a necessary and sufficient requirement for a piece to be played next to another piece already on the board that it have one and only one design in common with the piece that is already down. First, however, two exceptions must be noted. The universal bonus pieces which have no design and bear the number zero can be placed next to any piece whatsoever at any time during the play period without modifying the functioning of the system. The rule applies for all bonus pieces. It should further be noted that when the game is blocked, no big or smaller bonus piece can be played.

Thus, one can see that having a big (and to somewhat lesser extent) or small bonus piece is advantageous when the game is open. After the game has become closed, however, it is not good to have bonus pieces, since they typically bear high numbers on their face. A player, therefore, must employ strategy to determine whether to play his bonus pieces. The universal bonus pieces do not present this problem, since they bear the number zero.

In the normal play, the first player has the right to place down whichever of his pieces he wishes from among those he holds, taking into account his own interests and those of his teammate(s), if there is team play. For example, in the game having the mode 3–39 or 5–65, and with reference to FIG. 7, the first player may put down a piece bearing the number 11, which piece has two designs thereon, i.e. Capricorn and Pisces. The second player, for his part, may select a piece to play next to the previously played playing piece that bears either the design Capricorn or the design Pisces. If the second player elects to play a piece bearing the design Capricorn, such as the piece bearing the number 15, the layout produced will have two pieces each of which bear a Capricorn. In this case, it is said that Capricorn is "featured" or "highlighted", which obliges a subsequent player not to place down any but pieces that bear the design Capricorn which is, in this example, featured. For example, the next player could play a piece bearing the number 13 which bears the designs Libra, Taurus, Aquarius, and Capricorn.

At some point during the play a design ceases to be featured. A design ceases to be featured only after the number of pieces bearing this design equal to the first number in the mode of the game have been placed on the board. The sum of the numerals borne by these pieces, which have the featured design, and which have been placed on the board, equal the second number in the mode of play.

How a design ceases to be featured is made more clear by the following example again with reference to FIG. 7. In the mode 3–39, Ford puts an 11-piece (piece bearing the number 11) which bears the designs Capricorn and Pisces. Jimmy (player no. 2) puts down a 15-piece which bears the designs Capricorn and Aries.

This play by Jimmy makes Capricorn the featured design. Therefore, it follows that Valery (player no. 3) must place down a piece having a Capricorn, such as a 13-piece which bears the designs Taurus, Libra, Aquarius and Capricorn. After Valery plays the 13-piece, three pieces having the featured design will have been played. The number of pieces played having a featured design then corresponds to the first digit in the name of the mode. In addition, the sum of the numbers borne by these three pieces is $11+15+13=39$. In other words, the sum of the numbers on three pieces having one and only one design in common is 39, the second figure in the name of the mode.

Now, Capricorn automatically ceases to be the featured design and instead, the second, or one of the other designs on the last piece that was played will become the new featured figure. In this example, the new featured design will be Aquarius, Libra or Taurus. This depends only on the next player's selection of his playing piece. If the next player decides to play a piece bearing the design Taurus, the layout will include two pieces bearing Taurus and the third player will be forced to play a piece bearing a Taurus and so on.

In the case of the game having the mode 5–65, with refernce to FIG. 8, if Ford, the first player, plays a 1-piece which bears the designs Scorpio and Pisces, and if Jimmy, the second player, plays a 4-piece which has a Taurus and a Scorpio, Scorpio becomes the featured design. It follows therefore that subsequent players must play pieces bearing a Scorpio. Thus, Valery, the third player, plays by example a 19-piece which bears the designs Gemini, Libra, and Scorpio; Chase, the fourth player, plays an 18-piece which bears an Aries and a Scorpio. Finally, Giscard, the fifth player, by example, plays a 23-piece which bears the designs Cancer, Aquarius and Scorpio. After the fifth player plays the 23-piece, Scorpio ceases to be the featured design because there are five pieces on the board having the design Scorpio in common, and the sum of the numerals borne by these five pieces having the figure Scorpio in common is $1+4+19+18+23$ or 65, i.e. the second numeral in the mode 5–65. Now, the next featured design will be one of the other designs on the last piece played, i.e. the 23-piece. These are Cancer and Aquarius. Again, the next design featured will depend on the piece that the subsequent players play. It is important to note that when a design has ceased to be featured, it cannot be featured again until after another design has had its turn. Otherwise, one would be forced to replay the same pieces continually which would take all the charm and beauty from the game.

To insure game continuity and ease of play, it is important that the pieces be laid out by the players in a specified manner. A player should place his piece so that the design that is featured or to be featured lines up or matches the corresponding design on the previously played piece. The position of the 15-piece in FIG. 7 and the 4-piece in FIG. 8 are representative of this rule. The play of any piece actually requires consideration of two rules. First, if the play of the piece will not cause a design to cease to be featured, it should be positioned so that the featured design remains accessible to further matching. In FIG. 8, the position of the 19-piece is representative of this rule. Second, if the play of the piece causes a design to cease to be featured, the piece should be positioned so the once featured design is inaccessible for further matching. The positions of the 13-piece is FIG. 7 and the 23-piece in FIG. 8 are representative of this rule. Placing a piece which causes a design to cease to be featured in a manner renders the remaining designs accessible to further matching. The next-played piece will be positioned as is shown in the phantom playing pieces in FIGS. 7 and 8 depending on the next-featured design.

In addition to the above rules regarding the juxtaposition of the playing pieces, there is another rule which is an important integral feature of the game. This feature is called the Pass.

A player is said to pass when he or she cannot find at least one piece with at least one design in common with the piece next to which his piece must be played. For example, if Capricorn is the featured design, a player must pass if he does not have in his possession a piece bearing a Capricorn or a playable bonus piece. If no design is featured, a player must pass if he does not have a piece bearing a design in common with the last played piece with the exception of the prior featured design. A player can avoid passing by playing a playable bonus piece, big bonus piece, small bonus piece, or universal bonus piece, but the play of a playable bonus piece is not required. If a player passes, the next play belongs to the player seated to his right. And if the player seated to the right also cannot play because he does not hold an appropriate piece, the right of play continues to pass to the person to his right and so forth. If all the players, excepting the one who played the piece that has initiated the passing situation, are unable to play, this presents a situation called a General Pass. The game ends when all the players, without exception, are unable to play because none of them holds an appropriate piece so that play cannot continue. In this case, it is said that the game is closed or that the game is blocked.

A player does not have the right to pass and must play any playable piece in his possession. He may not use a pass to lead other players to believe that he lacks a piece bearing a specific design when, in fact, he has such a piece. A player may be penalized S number of points for passing unnecessarily.

The Goals and Possible Outcomes of the Game

The final goal of the game is to win the most possible matches using certain personal resources such as reflection, perception, observation, foresight, decision, planning, accounting, imagination and concentration. A player wins a match when he places down all his pieces before the other players do. In this case, the winning player holds no pieces, while his opponents hold at least one piece. A player may also win, in the case of a blocked game, if he has the lowest total of points on the pieces he holds, lower than that of his opponents. A series, which is made up of several matches, is won by the player who scores a total number of points equal to the number of pieces in the game, and does this before any of the other players. For example, in the mode 3–39, the number of points required to win a series is 68, i.e., the number of pieces that make up the game. This number, corresponding to the number of pieces, is called the limit of the game. In mode 5–65, the limit of the game is 218. Thus, when a player reaches the limit of the series he is said to have won the series.

All of the players who have not reached at least $5/6+4$ of the limit of the series lose the series. If, however, the other players have all reached $5/6+4$ of the limit, no losers are declared and a series is recommenced. For example, in the mode 3–39, there are 68 pieces and thus the limit to win the series is 68. The level that a player must reach in order not to lose the series will therefore be $5/6\times 68+4=60$ (This figure has been rounded off from the theoretical 60.666.). In the mode 5-65, the series limit is 218, corresponding to the number of pieces, and the level to be reached in order not to loss will therefore be $5/6\times(218)+4=185$ points (This figure has been rounded down from the theoretical 185.666.).

If, however, all the players reach $5/6+4$ of the limit that is to be reached to win when the winner himself reaches the limit, it is said that there is neither a loser nor a winner. The match is null, and, if one wishes, the series is recommenced. That is to say that the winner must have a margin (M) of points over the loser equal to $X-(5/6X+4)+1$. For example, in the mode 3-39, the margin (M) will be $M=X-(5/6X+4)+1=68-60+1=9$ points. So for the mode 3-39, $M=9$. For the mode 5-65, $M=34$.

How to Keep Score

Noting points is one of the easier and at the same time one of the most interesting phases of the game. At the start of the series, each player's name is written on a sheet of paper with enough space left underneath to mark the points. The sheet of paper is kept open and available to all players to avoid error or deception. The score sheet can also be entrusted to a judge worthy of confidence, who will be charged with writing down everyone's points, still under the scrutiny of interested parties. The following table is representative of a table useful in conjunction with keeping the point score.

| | A model table of points won by the players in each of the games of a series | | | |
|---|---|---|---|---|
| Names | Ford | Jimmy | Giscard | Valery |
| 1st | 10 pts | 0 pts | 5 pts | 18 pts |
| 2nd | 12 pts | 0 pts | 3 pts | 31 pts |
| 3rd | 3 pts | 0 pts | 9 pts | 21 pts |
| 4th | 5 pts | 25 pts | 5 pts | 9 pts |
| 5th | 20 pts | 30 pts | 18 pts | 7 pts |
| 6th | 25 pts | 17 pts | 11 pts | 2 pts |
| 7th | 16 pts | 16 pts | 9 pts | 20 pts |
| 8th | 0 pts | 16 pts | 9 pts | 20 pts |
| 9th | 0 pts | 9 pts | 5 pts | 2 pts |
| 10th | 0 pts | 6 pts | 16 pts | 8 pts |

How to Count Up the Points

As discussed above, the game is ended in two basic ways. First, a player has used up all his pieces and holds no more, while each of his opponents holds at least one piece. Second, the game is blocked or closed.

In the first case, the counting of points is relatively easy. The player who played all his pieces before anyone else is the uncontested winner of the game. This is comparable to a victory by knockout in boxing. The points of the winner are determined by the sum of the pieces that have not yet been played, that is, the pieces his opponents still hold.

If $S_{w1}$ is the total of points for the winner and if $N_{q2}$ is the number of pieces the second player holds and if $N_{q3}$ is the number of pieces the third player holds, and if $N_{qn}$ is the number of pieces the nth player holds, then the total number of points of the winner will be $S_{w1}=N_{q2}+N_{q3}+\ldots+N_{qn}$. Now, if the winner has his own astrological sign on the face of the piece with which he wins, because it is quite difficult to win in this manner, (having played all of one's pieces, and the last one to bear one's own sign), he is further compensated by multiplying the total number of points by the number of players in the game. So, if $N_p$ is the number of players, and if $T_{w1}$ is the total number of points for the winner, $T_{w1}=N_p(N_{q2}+N_{q3}+\ldots+N_{qn})$.

Once the first winner has been determined and his score correctely noted, the game continues among the other players until a second winner emerges who can win by any one of the two ways already noted. If the second winner is able to use all his pieces, his points are calculated in the same manner as the first winner. That is, if $T_{w2}$ is the total number of points of the second winner, and if $N_{q3}$ is the number of pieces the third player still holds, and if $N_{qn}$ is the number of pieces the nth player still holds, then the total numberof points for the second winner will be $T_{w2}=(N_p-1)(N_{q3}+N_{q4}+\ldots+N_{qn})$, if he has his sign on his last piece and $T_{w2}=(N_{q3}+N_{q4}+\ldots+N_{qn})$, if not. In a small game, 3-39, 3-15, where not all the astrological signs are used, a player can choose any other sign he wants. If he wants to take advantage of this rule, he must let his sign be known by everybody.

The calculation of points for each winner continues in the same manner until a single player remains. This player is obviously the last in the game and the only one who holds unplayed pieces. The total points for the last player is always equal to zero. Thus, if $T_f$ is the total number of points for the final player, then $T_f=0$.

This first case may be generalized by the following theorem: the total number of points of any winner is equal to the sum of unplayed pieces in the game multiplied by the number of players still left in the game, if the winner has his astrological sign on his last played piece.

In the case where the game is blocked, two scoring situations are presented. First, the game may be blocked before the absolute majority of pieces have been played. Second, the game may be blocked "properly" that is, after the majority of the pieces have been played. The second case will be treated first.

If the game becomes blocked after an absolute majority of the pieces have been played, a "closing" of the game occurs. In this situation, one simply determines the total of the numbers of the pieces each player holds to determine the order of winners of the game. The first winner is the player who has the lowest total of points on the pieces he still holds; the second winner is the player having the second lowest total of the points on the pieces he still holds, and so on. At this point the point score for each player is noted as follows. The score for the first player is the total of all the pieces not yet played in the game; the score for the second player is the total of all the pieces not yet played in the game minus the total of the pieces of the first player; the score for the third player is the total of all the pieces not yet played in the game minus the total of the pieces of the first and the second players. The score for the last player is evidently zero. Thus, if $T_{w1}$ is the total of the points for the first winner and is $N_{up}$ is the total of still unplayed pieces, then $T_{w1}$ equals $N_{up}$. Further, if $T_{w2}$ is the total number of points of the second winner and if $N_{up}$ is the number of pieces still unplayed, and further, if $N_{w1}$ is the number of pieces the first winner holds, then $T_{w2}=N_{up}-N_{w1}$.

If, in the first case, the game is blocked before the absolute majority of pieces in the game have been played, the game is declared "unsuccessful", and the blocker is penalized. If $T_t$ is the total number of tiles or pieces and if $M_{aj}$ is the absolute majority that should be played before the game is closed, then $M_{aj}$ equals 2/3 $T_t+1$. So, in the mode 3-39 $M_{aj}=2/3\times68+1$ or 46 pieces. Thus, in the mode 3-39, at least 46 pieces must be played before any player may be permitted to block the game. By similar calculation, in the mode 5-65, at least 146 pieces must be played before a player may block the game. If a player wrongfully blocks the game, he is penalized by increasing the number of points marked on the pieces he holds by a sum equal to the second number in the name of the mode that is being played. Thus, if $T_{pb}$ is the present total point score of the blocker, then with the "penalty" his total becomes $T_{pb}+39$, if the mode played is 3-39 and $T_{pb}+65$ if the mode is 5-65.

After having determined the penalty for the wrongful blocker which penalty is only employed to determine the rank of the players, the score is tallied as in the case where an absolute majority of pieces have been played prior to the game becoming blocked. In fact, it is possible to eliminate the numbers on the pieces entirely to produce a much simpler game. The score may be determined by any of the known methods for tile elimination type games. One way of determining the score would be to first count the number of pieces each player holds when the game is closed or blocked, or when one player discards all his pieces. The player who holds the least number of pieces is the first winner, the second least, the second and so on. If two players hold the same number of pieces, the player whose pieces bear the most designs is given the higher rank. Each players point score could then be determined, for example, by simply counting the number of pieces held by the lower ranked players.

The methods of scoring described herein are provided only for purpose of illustration and any other scoring method is within the scope of the present invention.

The above has been a detailed description of the game in modes 3-39 and 5-65. It is also possible to produce an independent 68-piece game corresponding to the above 3-39 mode, except that the numbers borne by the pieces are different. This game has the mode 3-15. In the mode 3-15, the game typically consists of 68 tiles of which 48 are basic playing pieces, 8 are special pieces and 12 are bonus pieces. There are two identical sets of 24 basic playing pieces each set consisting of two each of four distinct 2-section pieces, three each of four distinct 3-section pieces and four of a unique 4-section piece. Each of the 2-section pieces bear a number selected from the group consisting of 1, 3, 7 and 9. Each of the 3-section pieces bear a number from the group consisting of 2, 4, 6, and 8. Each of said 4-section pieces bear the number 5. Unlike the basic pieces of the mode 5-65, the basic pieces employed in a separate mode 3-15 game do not bear the mathematical symbol plus or minus.

In addition to the basic pieces, a separate mode 3-15 game generally employs six universal bonus pieces which bear only the number zero and six big bonus pieces which have eight sections, each section bearing one of the eight preselected indicia employed in the mode 3-15. The big bonus pieces each also bear one of the following numbers thereon: 17, 20, 24, 68, 45, and 240. Also employed in the separate mode 3-15 game are eight one-section special pieces all of which bear the number 15 and each of which bears one of the eight preselected indicia, so that all eight indicia are represented among the special pieces.

In a preferred embodiment of the separate mode 3-15 game, since only eight preselected indicia are required and there are twelve astrological symbols employed in the mode 5-65 game, one may replace the astrological symbols by, for example symbols employed by astronomers to represent the sun and the planets of the solar system. Likewise, in constructing very big games like modes 8-260 and 9-369 where eighteen and twenty different signs or symbols are employed respectively, a combination of the astrological and astronomical symbols may be employed.

The Game In General

The present inventive game has been described in detail with respect to modes 3-15, 3-39 and 5-65. There are, however, an unlimited number of games that can be constructed. It is, however, neither interesting nor practical to play or construct a game having too great a quantity of pieces. This is the reason that the embodiments 3-15, 3-39 and 3-65 are preferred. There follows, nevertheless, a discussion of the game having the general mode N-S with specific reference to the modes 3-15 (3-S), 4-34 (4-S), 5-65 (5-S), 6-111 (6-S), 7-175 (7-S), 8-260 (8-S) and 9-369 (9-S).

In the general mode description N-S, the first letter, N, means that any group of N pieces which have one and only one design in common form what may be called a cell. The second letter, S, in the general mode description N-S means that the sum of the numbers on the face of the pieces which constitute a cell equal S. Thus, S is the magic constant.

The structure of the present game is not arbitrary. Rather, it is completely mathematical and based on what mathematicians call magic squares. More precisely, all modes for the game are based on so-called normal magic squares, meaning the magic squares formed from the first $n^2$ natural numbers. Employing the first $n^2$ natural numbers make the games easier to play for the players who already have a great deal to remember, and because the mathematical operations which are part of the game are more easily solved. For example, one can form a third order magic square with the first nine ($3^2$) natural numbers, i.e., the integers from 1 through 9; here $n=3$, so $n^2=3^2$. In this case, the magic constant S is 15, providing a game having the mode 3-15. The numbers 1, 7, 13, 31, 37, 43, 61, 67 and 73 could also be employed, but that would produce a different third order magic square having the magic constant 111. (The magic constant S is the total of any one of the rows or columns of the corresponding magic square.) The first example employing the nine natural numbers produces a normal magic square, whereas the second example is a non-normal magic square, since it was produced from numbers that are not selected from the first nine natural numbers. This distinction is important since the preferred modes of the present game are based on "normal magic squares", and merely changing the numbers on the face of the basic pieces to produce a mode based on "non-normal magic squares" is still within the ambit of the present invention, although not preferred. In addition, the present invention can be embodied in a game where the order is not just three or nine to produce a game employing a greater quantity of pieces.

Since it is neither practical nor necessary to provide a detailed description of every conceivable mode of the present game, some general formulae are provided so one skilled in the art may produce any game having the general mode N-S. For the mode N-S, if N is known, S is obtained by applying the following formula: $S=((1+N^2)/2)\times N$.

To determine the number of basic pieces employed in one set of basic pieces for any mode, the following formula applies: $Q_{bp}$(quantity of basic pieces)$=2N^2+2N$ or $2(N^2+N)$ or $2N(N+1)$.

The number of bonus pieces and special pieces is also directly related to the mode of the game. The number of special pieces is obtained by applying the following formula: $Q_{sp}$(quantity of special pieces)$=2N+2$ or $2(N+1)$. In the case where there are really two games in one, as in mode 5-65 which also contains mode 3-69 an additional quantity of special pieces corresponding to the mode of the smaller game is added. For example: $2(N+1)+2(N_1+1)+2(N_2+1)+2(N_n+1)$. Likewise, in a mode comprising three games, for example 7-175, a quantity of special pieces corresponding to each of the two smaller games are added, and so on.

The special pieces bear a number on their face which is equal to the sum of the numbers on the face of any group of N pieces which have one and only one design in common. As noted above, each of these groups is called a cell and the sum is the magic constant S. Thus, the special pieces in the mode 3-15 bear the number 15 and the special pieces in the mode 5-65 bear the number 65 and 39 for 3-39. So, the special pieces bear the number S in the mode N-S. Furthermore, the number of special pieces employed equals the total number of possible cells in the game.

In addition to the basic and special pieces, the present invention contemplates the provision of bonus pieces which add the element of chance and provide specific information about the games. For example, in the mode 3-15 there are generally six bonus pieces each bearing a different number. The number borne by the bonus pieces is directly related to the mode of the game and the number of pieces employed. More specifically in the game having the mode 5-65, which also includes the mode 3-39, twelve bonus pieces are employed, the first six being the small bonus pieces, which are only used to play the 3-39 game, and which are used in conjunction with the big bonus pieces to play the big game having the more 5-65. The meaning of the bonus pieces set forth in FIGS. 3 and 4 is more fully appreciated by reference to the following table.

| Number | Bonus Pieces Meaning |
|---|---|
| 17 | number of different numbers employed in mode 3-39 |
| 20 | number of non-basic pieces |
| 24 | number of different pieces |
| 68 | total number of pieces |
| 117 | sum of the numbers borne by the different basic pieces |
| 624 | sum total of all numbers borne by all the basic pieces employed (note: 2 sets for mode 3-39) |
| 40 | number of different numbers used in mode 5-56 |
| 38 | number of non-basic pieces |
| 58 | number of different pieces |
| 218 | total number of pieces |
| 325 | sum of the numbers borne by the different basic pieces |
| 2340 | sum total of all numbers borne by all the basic pieces employed (note: 3 sets of basic pieces in mode 5-65) |

It should be noted that the bonus pieces above the dashed line in the table are used alone when one plays a game having the mode 3-39. These pieces are also used in conjunction with the other bonus pieces to play the game having the mode 5-65. From the table, it can be noted that the numbers contained on the bonus pieces relate to the number of numbers employed, the number of non-basic pieces, the number of different pieces, the total number of pieces, the sum of the numbers borne by the different basic pieces and the sum total of all the numbers borne by all the basic pieces employed in the game.

Applying the formulae to determine the number of basic and special pieces employed, one sees that in the mode 3-15, where $N=3$, the number of basic pieces equals $Q_{bp}=2N(N+1)=(2\times3)=24$. The number of special pieces employed is $Q_{sp}=2(N+1)=2(3+1)=8$. Applying these formulae to various other modes one finds that 40 basic pieces and 10 special pieces are required for mode 4-34, 60 basic and 12 special pieces for mode 5-65, 84 basic and 14 special pieces for mode 6-111, 112 basic and 16 special pieces for mode 7-175, 144 basic and 18 special pieces for mode 8-260 and 180 basic and 20 special pieces for mode 9-369. In modes containing a sub-mode, or smaller game, special pieces for the smaller game are added.

Normally, for any mode of the present game, N-S, at most only a number equal to N should play, although some modes provide a combination of games with sub-modes allowing for different numbers of players. It is, however, not necessary to have pieces for all the modes to accomodate any number of players. In any event, to have pieces to play the game in all modes, only two modes are required, the mode 8-260 which provides a game for eight players, six players, four players or for any even number of players and the mode 9-369 which provides a game for nine players, seven players, five players and three players or a game for any odd number of players. It is possible to have so many games in one mode because the games are based on concentric or bordered normal magic squares.

The most preferred embodiment of the present invention is the mode 5-65, since it is the only mode which makes it possible to use exactly the twelve astrological symbols. For that reason, mode 5-65 is most preferred and can be considered a standard game. Since mode 5-65 is so important, it has been adapted to be played by any number of players, from two to n. This is the reason for constructing the mode 5-65 with three sets of basic pieces. The players are, of course, free to use any number of sets of basic pieces depending only on their individual preferences and personality. For example, one set of sixty basic pieces, with or without special and/or bonus pieces may be employed from 2 to 5 players. Further, as many as three sets of basic pieces may be used, with or without the special and bonus pieces, for a game playable from 2 to more than 12 players.

Although the description of the present inventive game appears quite complex, playing the game, in fact, is quite simple and enjoyable. While playing, it is not necessary to actually total the number of the pieces, since the harmonious correspondence between the numbers and designs borne by the pieces, insures that the correct totals will be reached. Thus the players are free to enjoy themselves and concentrate on strategy.

Obviously many modifications and variations of the present invention are possible in light of the above teachings. It is therefore to be understood that within the scope of the appended claims, the invention may be practiced otherwise than as specifically described.

I claim:

1. A game apparatus for playing a game having the mode N-S, wherein N and S are integers, said apparatus comprising at least one set of playing pieces, each playing piece divided into a plurality of sections and each section bearing one of a number of preselected designs, with no piece bearing more than one of a particular design, said at least one set comprising a first plurality of two-section pieces, a second plurality of three-section pieces and a third plurality of four-section pieces, each piece also associated with a number, the number associated with each piece, number of sections and designs being selected so that the sum of the numbers associated with N pieces having one and only one design in common is S.

2. The apparatus of claim 1, wherein the number associated with each piece is borne thereon.

3. The apparatus of claim 1, wherein N-S is 5–65, the number of preselected designs is twelve, said first plurality of two-section pieces is thirty-two, said second plurality of three-section pieces is twenty-four, and said third plurality of four-section pieces is four.

4. The apparatus of claim 3, wherein said first plurality of two-section pieces consists of two each of sixteen distinct two-section pieces, said second plurality of three-section pieces consists of three each of eight distinct three-section pieces and said third plurality of four-section pieces consists of four each of a unique four-section piece.

5. The apparatus of claim 4, wherein the numbers associated with the playing pieces are selected from the group consisting of the integers from 1 through 25 inclusive.

6. The apparatus of claim 5, wherein the numbers associated with the pieces are borne thereon.

7. The apparatus of claim 6, wherein the two- and three-section pieces bear one of two preselected symbols and the four-section piece bears a third symbol.

8. The apparatus of claim 3, wherein said at least one is three.

9. The apparatus of claim 1, wherein the designs are astrological symbols.

10. The apparatus of claim 1, further comprising playing pieces selected from the group consisting of bonus pieces, special pieces, universal bonus pieces and combinations thereof.

11. The apparatus of claim 4, further comprising playing pieces selected from the group consisting of bonus pieces, special pieces, universal bonus pieces and combinations thereof.

12. The apparatus of claim 1, wherein N-S is 3–39, the number of preselected designs is eight, said first plurality of two-section pieces is eight, said second plurality of three-section pieces is twelve and said third plurality of four-section pieces is four.

13. The apparatus of claim 12, wherein said first plurality of two-section pieces consists of two each of four distinct two-section pieces, said second plurality of three-section pieces consists of three each of four distinct three-section pieces, and said third plurality of four-section pieces consists of four of a unique four-section piece.

14. The apparatus of claim 12, wherein the number associated with the pieces are selected from the group consisting of integers from 9 through 17 inclusive.

15. The apparatus of claim 14, wherein the numbers associated with the pieces are borne thereon.

16. The apparatus of claim 12, wherein N-S is 3–15.

17. The apparatus of claim 12, wherein said at least one is two.

18. A game apparatus for playing a game having the mode 5–65 said apparatus comprising a plurality of playing pieces, said playing pieces comprising at least one set of playing pieces, each piece divided into a plurality of sections and each section bearing one of twelve different preselected designs, with no piece bearing more than one of a particular design, each set comprising a plurality of two-section pieces, a plurality of three-section pieces and a plurality of a unique four-section piece, each of said two-section pieces associated with a number selected from the group consisting of 1, 2, 4, 5, 6, 8, 9, 11, 15, 17, 18, 20, 21, 22, 23, 24 and 25, each of said three-section pieces associated with a number selected from the group consisting of 3, 7, 10, 12, 14, 16, 19 and 23, and each of said four-section pieces associated with the number 13, the numbers, number of sections and particular designs having been selected so that the sum of the numbers associated with any five pieces having one and only one design in common is 65.

19. The apparatus of claim 18, wherein the two-section and three-section pieces each bear one of two preselected symbols, and the four-section pieces bear a third symbol.

20. The apparatus of claim 18, further comprising a plurality of small bonus pieces, each small bonus piece having eight sections each section bearing a different one of eight of said preselected designs.

21. The apparatus of claim 18, further comprising a plurality of big bonus pieces, each big bonus piece having twelve sections with each section bearing a different design.

22. The apparatus of claim 18 further comprising a plurality of universal bonus pieces having one section with no design.

23. The apparatus of claim 18 further comprising a plurality of special pieces, each special piece having one section and bearing one of the twelve preselected designs.

* * * * *